United States Patent [19]

van Beek

[11] Patent Number: 4,669,886

[45] Date of Patent: Jun. 2, 1987

[54] APPARATUS FOR PREPARING A MIXTURE

[75] Inventor: Pieter E. van Beek, Woerden, Netherlands

[73] Assignee: B.M.I. B.V., Netherlands

[21] Appl. No.: 710,084

[22] Filed: Mar. 11, 1985

[30] Foreign Application Priority Data

Mar. 13, 1984 [NL] Netherlands ..... 8400798

[51] Int. Cl.[4] ..... B28C 7/10

[52] U.S. Cl. ..... 366/18; 177/70; 222/56; 366/20; 366/37; 366/141

[58] Field of Search ..... 366/18, 20, 27, 28, 366/29, 30, 33, 35, 38, 42, 43, 141, 152, 160, 162, 156, 186, 193, 37, 181, 8; 177/1, 70; 222/1, 56

[56] References Cited

U.S. PATENT DOCUMENTS

| | | | |
|---|---|---|---|
| 2,743,896 | 5/1956 | Nauta | 177/70 |
| 2,975,884 | 3/1961 | Kayser | 366/18 X |
| 3,385,571 | 5/1968 | Preeman | 366/18 |
| 3,871,628 | 3/1975 | Pulk et al. | 366/20 |
| 3,885,774 | 5/1975 | Harris et al. | 366/20 |
| 3,905,586 | 9/1975 | Wall | 366/18 |
| 4,071,226 | 1/1978 | Miller | 366/35 X |
| 4,498,783 | 2/1985 | Rudolf | 366/141 |

FOREIGN PATENT DOCUMENTS

| | | | |
|---|---|---|---|
| 2090761 | 7/1981 | United Kingdom | 366/20 |

*Primary Examiner*—Philip R. Coe

[57] ABSTRACT

An apparatus for preparing a mixture, such as mortar, with predetermined quantities by weight of the components, such as sand, cement and the like, a supply of which is present in container compartments 4, 5 of e.g. hopper 1. The container compartments are each connectable to a metering conveyor 11, 12 of the apparatus. The apparatus is further provided with a mixing vessel 13 having stirring means, the vessel being supported at least partly on force absorbers 14 of weighing means. The weighting means are coupled with control means 15 for successively putting into operation the metering conveyor means for the various components.

3 Claims, 4 Drawing Figures

APPARATUS FOR PREPARING A MIXTURE

The present invention relates to an apparatus for preparing a mixture, such as mortar, with predetermined quantities by weight of the components, such as sand, cement and the like, a supply of which is present in container compartments, each being connectable to a metering conveyor means, said apparatus comprising weighing means and a mixing vessel having stirring means, there being provided control means coupled to the weighing means for successively putting into operation the metering conveyor means for the separate components.

In general, the weighing of components of a mixture has the advantage over adding volumes together that the risk of bad mixtures due to failure of the volumetric supply of components is smaller. Known devices for preparing a mixture of quantities by weight, however, are expensive, because separate weighing means for weighing the components are necessary, and the operation of the known devices is comparatively slow, since each component has first to be weighed before the required mixing time begins.

It is an object of the present invention to provide a mixture preparation apparatus of the above described type wherein the above drawbacks are avoided.

To this effect, in the apparatus according to the present invention, the mixing vessel is at least partly supported on force absorbers of the weighing means.

Thus, the mixing vessel functions at the same time as a weighing vessel. The control means coupled to the weighing means terminate the supply of a component as soon as the desired quantity by weight thereof has been deposited in the vessel and set the metering conveyor means of the next component into operation, etc. In the meantime, the stirring means may have been put into operation and when all components are present in the mixing vessel in the desired quantities, the stirring means can be kept in operation for a predetermined period of time. The vessel can then be emptied and the next mixture charge can be prepared.

The stirring means in the mixing vessel may be provided with a single stirring shaft having semispiral, oppositely conveying stirring arms enabling a careful but effective mixing of the components, which is important for the use of the apparatus for preparing mortars.

The weighing-cum-mixing vessel may be combined, in a further embodiment of the present invention, with a plurality of metering conveyor means and control means to form a mixture preparation unit which is detachably connectable to a hopper or like container having compartments for the various mixture components.

Thus, the assembly of mixture preparation apparatus and metering conveyor means can remain at the site of use and filled containers with the mixture components in separate container compartments can be supplied and coupled to said assembly for replacing an empty container.

In a preferred embodiment of the present invention, for the purpose of coupling the mixture preparation unit to the components container, the inlet openings of the metering conveyors, on the one hand, and the outlet openings of the associated container compartments, on the other, are arranged in mutually parallel planes inclined at a steep angle relative to the horizontal, with the plane containing the container outlet openings intersecting the tapered container outlet.

The mixture preparation unit can then be shifted or wheeled into position from aside, with the inlet openings of the conveyor means in accurately registered association with the container outlet openings, without manipulations with the heavy, filled container standing on legs being required.

With containers having a tapered outlet, such as most hoppers, the outlet openings, according to the present invention, lie in a plane intersecting the tapered portion. Thus, not only relatively large inlet openings for the conveyor means are formed, enabling an optimum filling of the conveyors, but also the chance of arching, which frequently occurs in the tapered outlet portion of hoppers and impedes the free outflow of material, is substantially reduced. An arch occuring in a tapered outlet in fact, is supported on the walls converging towards the outlet opening. In the apparatus according to the present invention at least a part of one of the converging walls is interrupted by the inlets of the conveyor means placed at that location, and the conveyor means, when in operation, such as screw conveyors, disturb one of the arch legs, thus preventing arching.

In the case of containers having the shape of elongate hoppers transported in horizontal position, and which at the site of use are pushed off the vehicle and are tilted into an upright position, the shortening of the conventional tapered outlet moreover results in a displacement of the centre of gravity in the direction of the lower end, which facilitates the tilting and the erection of the hopper.

A practical embodiment of the present invention comprises an assembly of a hopper of rectangular configuration and having an outlet portion in the form of a truncated pyramid having a rectangular base and an apex surface with one or more partitions being provided within the hopper and each of the compartments formed by said partitions terminating in said apex surface into an outlet closable by a slide, said outlet being bounded by a coupling flange and a mixture preparation unit. According to the invention the mixture preparation unit is mounted in a movable frame and is provided with a weighing-cum-mixing vessel and with screw conveyors terminating in said vessel, which conveyors are adjustable and controllable by a control unit processing weighing signals in a set mixing program, the inlet openings of the screw conveyors being arranged at an angle of inclination and being connectable to the hopper by means of the coupling flange, the apex surface of said hopper being disposed at the same angle of inclination.

Although not restricted thereto, the mixture preparation apparatus according to the present invention is excellently suitable for preparing at a construction site mortar from sand or similar aggregate and cement or a similar binder.

It is observed that the arrangement of the screw conveyors as described hereinbefore can also be used for volumetric mixture preparation, with the advantage of the relatively large connection openings having a tapered hopper outlet and hence a better delivery of material.

One embodiment of the apparatus for preparing a mixture according to the present invention will now be described by way of example, with reference to the accompanying drawing, in which.

Figure 1:
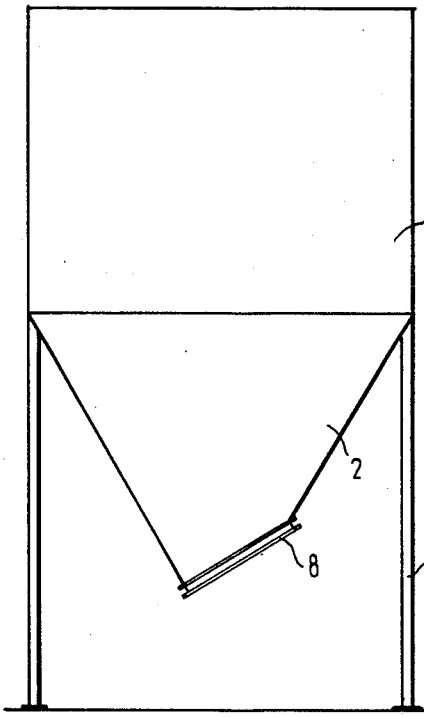
FIG. 1 is a diagrammatic side view of the hopper according to the present invention.
Figure 2:
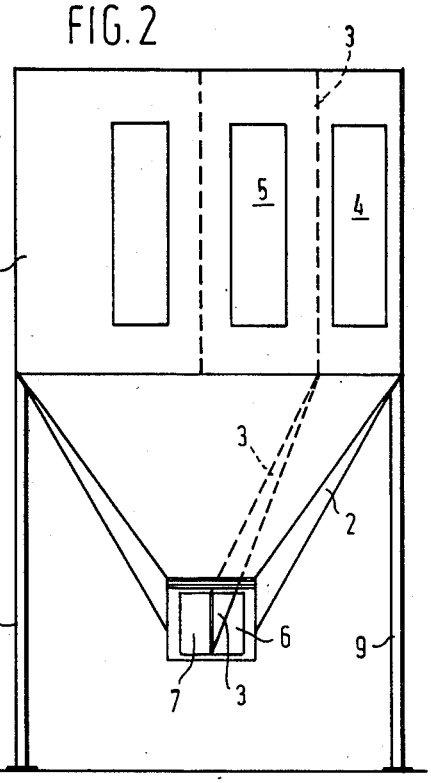
FIG. 2 is an end view of the hopper of FIG. 1.

The drawing exclusively shows those elements that are necessary for a proper understanding of the present invention. For instance, filling holes, anti-freeze heating elements, draining elements, air surge generators, filters etc. have been omitted.

According to the drawing, there are formed in a hopper 1 having a frusto-conical outlet 2, by means of a partition 3, compartments 4, 5 terminating in outlet openings 6, 7 bounded by coupling flanges 8 and fitted with shut-off slides (not shown). The hopper stands on legs 9.

Figure 3:
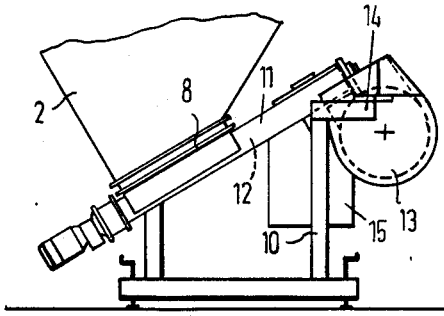
FIG. 3 is a side view of the mixture preparation apparatus.

As shown in FIG. 3, the mixture preparation apparatus comprises a movable frame 10 carrying two diverging screw conveyors 11, 12 in this embodiment, wherein the hopper has two compartments 4, 5 and two outlet openings 6, 7. The inlet openings of the screws 11, 12, can be connected to the hopper outlet openings, by means of coupling flanges 8.

Figure 4:
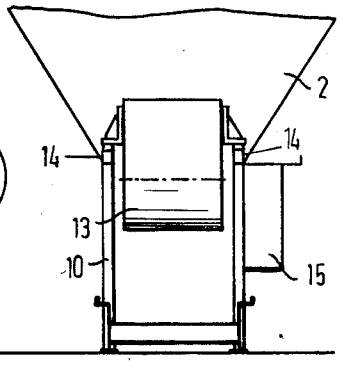
FIG. 4 is an end view of the apparatus shown in FIG. 3.

Screw conveyors 11, 12 terminate in a mixing vessel 13 having stirring means, not shown. Mixing vessel 13, into which further supply means for other mixture components may terminate, is likewise adapted for weighing the contents of the vessel. As shown in FIG. 4, the vessel 13 rests on the frame 10 by means of weighing force absorbers 14 whose observations are passed on to a control unit 15 in which a given mixture, e.g. a mortar, can be set by entering given quantities by weight of sand, e.g. from compartment 4, cement from compartment 5 and water from a supply not shown.

The screw conveyor 12 is set in operation by the control unit 15 until the desired quantity by weight of sand is detected in vessel 13. Subsequently, if desired with simultaneous operation of the stirring means, the screw conveyor 11 is set into operation to deliver a desired quantity by weight of cement to the vessel 13. The mixing, possibly while supplying water, therefore already takes place during the supply and weighing of at least one of the components. After termination of the delivery of components, the required mixing time is completed, the weighing-cum-mixing vessel is emptied and a new cycle can be started.

I claim:

1. An apparatus for preparing descrete batches each of which contains a mixture of predetermined quantities by weight of components, comprising a stationary hopper divided into a plurality of compartments for receiving separate components and separate outlet openings for discharging a component from each said compartment, base means fixedly mounting said hopper in a particular location respectively; a mixing and weighing structure comprising weighing means provided with force absorbers, a mixing vessel supported at least in part by said force absorbers, a movable base supporting said mixing and weighing structure, said movable base being adapted to move said mixing and weighing structure from adjacent to said hopper to other selected locations, said mixing and weighing structure further including a plurality of metering conveyor means having inlet openings and means for detachably connecting said conveyor inlet openings with said hopper discharge outlets, respectively, for metering and delivering said components separately to said mixing vessel, and control means on said movable base for coupling said weighing means with said metering conveyor means for successive operation of each metering conveyor means, thereby separately delivering to said mixing vessel a weighed quantity of each component for each separate batch.

2. An apparatus according to claim 1, wherein said hopper is provided with downwardly and inwardly tapered side walls terminating in said outlet openings, said inlet openings of said metering conveyors, on the one hand, and said outlet openings of said hopper, on the other, being arranged in mutually parallel planes inclined at a steep angle relative to the horizontal, the plane of said outlet openings intersecting said tapered side walls.

3. An assembly for preparing a plurality of descrete batches each of which includes a mixture of predetermined quantities by weight of components comprising a hopper for such components, said hopper being stationarily fixed at a single location, and a mixture preparation unit detachably connectable thereto, said hopper having a body portion of rectangular configuration and an outlet portion in the form of an inverted truncated pyramid having a rectangular base and terminating in a lower inclined face, at least one partition being provided within the hopper to establish compartments terminating at said face and forming closable outlet openings, said outlet openings being bounded by an inclined coupling flange;

said mixture preparation unit being mounted in a frame which includes means for moving said unit from adjacent to said hopper to other locations which are spaced from said hopper, said unit further including means for weighing said vessel and its contents, and control means on said movable frame for controlling said conveyors in a predetermined mixing program in accordance with weighing signals derived from said weighing means, said mixing vessel having a conveyor which is provided with inlet openings arranged at the same angle of inclination as said coupling flange on said hopper and having means for detachably connecting said inlet openings to said hopper outlet openings for receiving material therefrom.

* * * * *